US005996525A

United States Patent [19]

Gray

[11] Patent Number: 5,996,525

[45] Date of Patent: Dec. 7, 1999

[54] BELLMOUTH EXIT ANGLE ADAPTER

[75] Inventor: Charles E. Gray, North Stonington, Conn.

[73] Assignee: The United States of America as represented by the Secretary of the Navy

[21] Appl. No.: 09/114,250

[22] Filed: Jul. 6, 1998

[51] Int. Cl.[6] ..... B63B 21/04

[52] U.S. Cl. ..... 114/253

[58] Field of Search ..... 114/242, 121, 114/244, 253, 254; 254/134.3 R; 242/157 R

[56] References Cited

U.S. PATENT DOCUMENTS 4,317,185 2/1982 Thigpen et al. ..... 114/253
4,412,672 11/1983 Zelins ..... 254/134.3 R
4,748,927 6/1988 Bujacich ..... 114/121
5,517,938 5/1996 Wood ..... 114/244
5,715,871 2/1998 Covelli et al. ..... 242/157 R

*Primary Examiner*—Stephen Avila
*Attorney, Agent, or Firm*—Michael J. McGowan; Robert W. Gauthier; Prithvi C. Lall

[57] ABSTRACT

The present invention comprises a bellmouth adapter assembly for deploying and retrieving a towed array from a vessel that includes a bellmouth having a rearwardly extending tubular member with an axial centerline, and a distal first flange member extending outwardly from the tubular member, the first flange member having a first inner curved surface. The adapter has a second flange member which is concentrically superimposed over and fixed to the first flange member and has a second inner curved surface. This second curved surface is selected so that its bend radius is larger than the bend radius of the first inner curved surface.

10 Claims, 1 Drawing Sheet

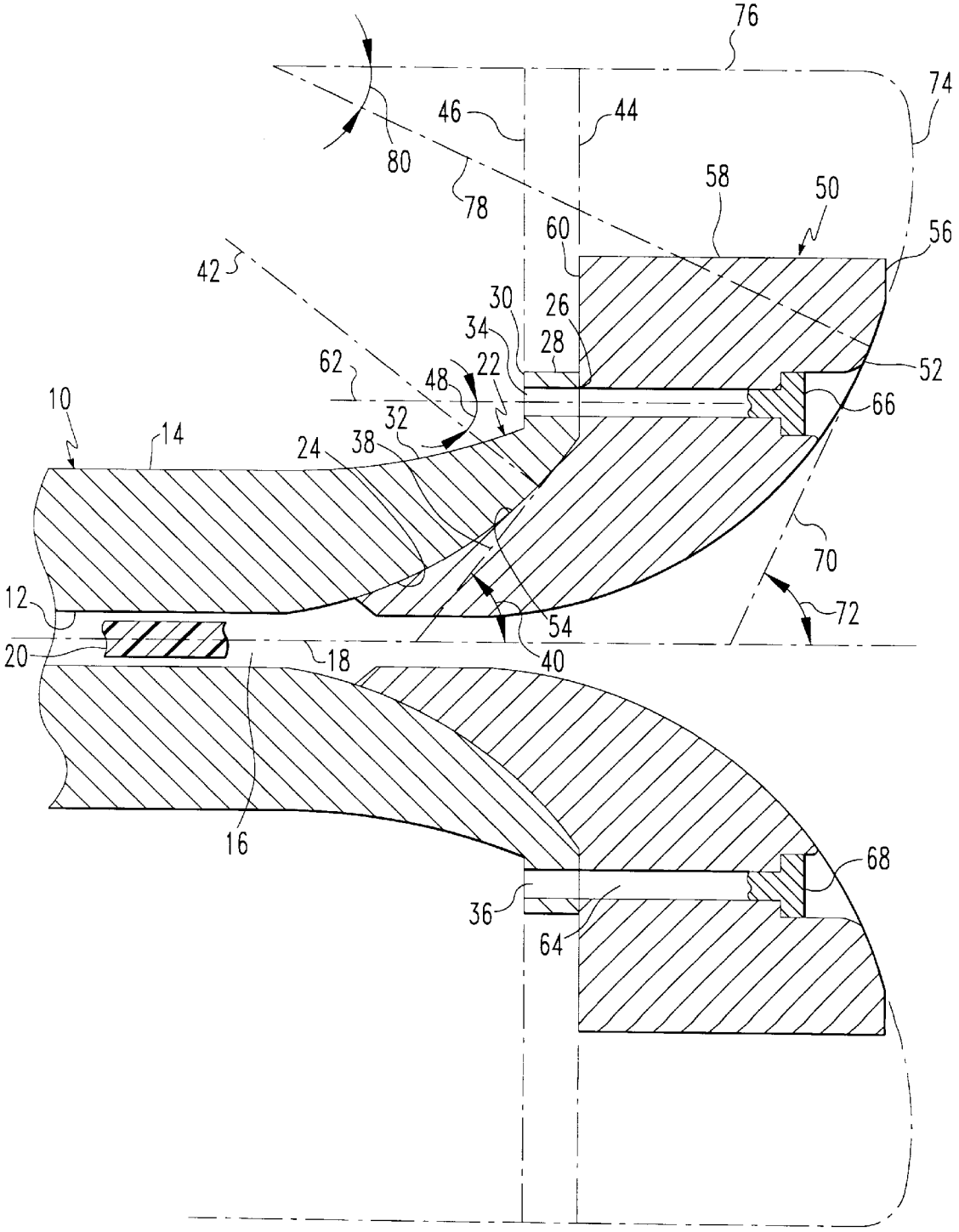
76
74
46
44
80
78
58
50
60
56
42
30
26
34
28
52
62
48
22
66
10
32
14
24
38
70
12
54
72
20
18
40
16
68
36
64

BELLMOUTH EXIT ANGLE ADAPTER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to marine towing apparatus and more particularly to towed sonar array cables.

(2) Description of the Prior Art

It is known in the art to provide a winch and stowage reel assembly for deploying and retrieving a towed sonar array cable from a submarine. The winch assembly includes a driven capstan and an idling drum. In operation, the capstan rotates to bring a towed array cable onto the capstan and thence onto the drum and back to the capstan, usually for a plurality of turns, and thence onto the stowage reel. To pay out the towed array cable, which typically would have an array fixed to a free end thereof, the array being of substantially the same configuration as the cable, the capstan draws cable from the stowage reel and, after a plurality of turns around the idling drum, urges the cable through a bellmouth and out of the submarine to facilitate towing of the array well aft of the submarine's propulsion propellers. Such an arrangement is shown, for example, in U.S. Pat. No. 5,263,432 to Wood, particularly with reference to FIGS. 1 and 2 therein.

Various arrangements have been suggested by the prior art for improving the deployment of cables from bellmouths or marine vessels.

U.S. Pat. No. 4,064,358 to Smith et al. discloses a termination between a submarine coaxial cable and a submerged repeater housing. It employs an anchor assembly for transferring the load in the cable core to the repeater housing, and a protective boot assembly for surrounding and supporting the cable where it extends away form the anchor assembly. The boot assembly is rigidly connectable to the housing. Movement of the cable within the boot tube is permitted to a greater extent near the free end of the boot assembly than near the housing, by means of a flexible tube and bellmouth assembly; in order to account for the stresses associated with the cable handling and recovery.

U.S. Pat. No. 4,313,392 to Guenther et al. discloses a system for deploying and retrieving a seismic source assembly form a marine seismic vessel. The system comprises a guide track that is secured to the underside of an upper deck of the vessel. The chain, which absorbs most of the strain due to towing, passes through the track and is safely confined therein during the deployment and retrieval of the source assembly. A connector is attached to the chain at each point where a seismic source and a buoy line is to be attached. As the chain is unreeled and as each connector approaches the track, a source and a buoy line is attached to that respective connector. The track is constructed so a connector on the chain with both a source and a buoy line attached can pass therethrough. This procedure is continued until the seismic source assembly is deployed.

U.S. Pat. No. 4,317,185 to Thigpen et al. discloses a towing link consisting of spaced-apart head and tailpieces. The headpiece includes a towing eye and a pair of lugs for receiving the stress members of a streamer and a lead-in cable. The tailpiece defines a pair of bores through which the stress member and electrical conductors of the two cables are inserted and sealed. A pair of mating connector plugs is provided to interconnect corresponding conductors of the two cables.

U.S. Pat. No. 4,877,355 to VanPelt discloses a cable embedding device comprising a framework for supporting and hydraulically raising and lowering a rock saw and a cable carrying bellmouth relative to two spaced-apart sled-type runners. Each sled carries part of a jet spray system and an educator system in which the spray system creates a slurry and in which the educator system carries and discharges the slurry to the back of the device. A hinge and a hinge-roller assembly connect the framework to the device for relative movement there-between. The bellmouth is shaped to curve around the rock saw, and its pedestal foot supports the bellmouth in the cable embedding and trenching operations.

One area in which the prior art has not suggested an improvement is in preventing excessive bending of the towed array during on or off-loading from or to a barge or pier.

Conventionally, as the towed array is on or off loaded, the minimum bend radius of the towed array is occasionally violated. Even though the bellmouth at the exit point on the submarine is designed to incorporate the minimum bend radius as one of its features, it was designed to handle situations which would be encountered during typical deployment and retrieval situations at sea, not during on and off loading of the array from or to a barge or pier. In the on or off-loading scenario, the angle of the array exiting the bellmouth towards the barge is often steep enough to bend around the lip of the bellmouth that has a radius much less than the minimum bend radius.

An object, therefore, of the bellmouth exit angle adapter of the present invention is to prevent the minimum bend radius of the towed array from being violated, as the array is on or off loaded between a submarine and a barge or pier.

SUMMARY OF THE INVENTION

The present invention comprises a bellmouth adapter assembly for deploying and retrieving a towed array from a vessel that includes a bellmouth having a rearwardly extending tubular member with an axial centerline, and a distal first flange member extending outwardly from the tubular member, the first flange member having a first inner curved surface. The adapter has a second flange member which is concentrically superimposed over and fixed to the first flange member and has a second inner curved surface. This second curved surface is selected so that its bend radius is larger than the bend radius of the first inner curved surface.

Preferably, the bellmouth exit angle adapter is fastened to the exterior of the bellmouth housing. The towed array is fed through the bellmouth exit angle adapter. The bellmouth exit angle adapter prevents the minimum bend radius from being violated at the bellmouth of a submarine, as the array is on or off loaded between a submarine and a barge. While the typical submarine bellmouth can usually support exit angles of between 0° and 30°, the use of the adapter would allow exit angles between 0° and 90°.

Also included within this invention is a method in which a bellmouth housing having a tubular member with a distal first flange member having a curved inner surface is provided with a second flange having a curved inner surface concentrically interposed over the first flange member. The curve of the inner surface of the second flange is selected so that the tangent on this curve intersects the centerline of the tubular member at a larger angle than the angle of the tangent to the curved inner surface of the first flange to the centerline.

BRIEF DESCRIPTION OF THE DRAWINGS

Other objects, features and advantages of the present invention will become apparent upon reference to the following description of the preferred embodiments and to the drawing, wherein:

FIG. 1 is a vertical cross section of an adapted bellmouth representing a preferred embodiment of the present invention.

DESCRIPTION OF THE PREFERRED EMBODIMENT

Referring FIG. 1, the bellmouth housing includes a tubular member 10. This tubular member 10 includes an inner surface 12, an outer surface 14, and a central axial bore 16 with an axial centerline 18. Inside the axial bore 16 there is a towed array 20, which is shown in fragment. At the distal end of the tubular member 10 there is a first flange member 22. This first flange member 22 includes a curved inner surface 24, a terminal radial surface 26, an axial outer surface 28, a recessed radial surface 30, and a curved outer surface 32 which is aligned with the outer surface 14 of the tubular member. Between the distal radial surface 26 and the recessed radial surface 30, there is a plurality of transverse bores such as transverse bore 34 and transverse bore 36. The curved inner surface 24 has a tangent 38 which intersects with the axial center line 18 of the tubular member to form a first acute angle 40. The curve of the curved surface 24 has a radius 42. As a further reference, there is a distal radial plane 44 and a recessed radial plane 46. An angle 48 is formed between the radius 42 and the centerlines of the transverse bores 34 and 36, which are perpendicular to radial planes 44 and 46. Angles 40 and 48 will preferably be from 25° to 35° and will more preferably be 30°.

The bellmouth adapter of the present invention has a second flange 50 that is superimposed over the first flange 22. This second flange has a curved inner surface 52 and a curved intermediate surface 54. It will be seen that this curved intermediate surface 54 bears against and coincides with the curved inner surface 24 of the first flange. The second flange also has a distal radial surface 56, an axial surface 58 and a recessed radial surface 60. Between the distal radial surface 56 and the recessed radial surface 60 there is a plurality of transverse bores such as transverse bore 62 and transverse bore 64. Bores 62 and 64 are axially aligned respectively with bores 34 and 36 in the first flange member 22. Bolts 66 and 68, shown in fragment, are mounted respectively in aligned bores 34 and 62 and aligned bores 36 and 64, respectively. The curve of the curved inner surface 52 has a tangent 70 that forms an acute angle 72 with a centerline 18 of the tubular member 10. This angle will preferably be from 60° to 90° and more preferably 80°. As a further reference, the curve of the inner surface 52 is shown as extension 74; and a plane parallel to axial surface 58 and perpendicular to planes 44 and 46 is shown as plane 76. The radius of the curve of the inner surface 52 is shown as radius 78. Angle 80 is formed between plane 76 and radius 78. The radius 78 of the curve of the inner surface 52 is larger than radius 42 of the curve of the inner surface 24. Angle 80 is equal to angle 72 and is preferably from 60° to 90° and more preferably 80°.

It will be appreciated that the bellmouth adapter of the present invention allows for an efficient exit of the array without violating the minimum bend radius for the array.

The bellmouth exit angle adapter of this invention extends the tangency point of the minimum bend radius out to the point where the array can be taken up by a reel on the barge without violating the minimum bend radius. Size and geometrical changes may be made to accommodate different bellmouth geometries, bend radius requirements, strength, and load requirements, ship interface requirements, and the like.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A bellmouth adapter for attachment to a tubular bellmouth on a vessel for deploying and retrieving a towed body from the vessel, along an axial centerline of the bellmouth and over a curved inner surface of the bellmouth having a certain first radius, the bellmouth adapter comprising a flange member concentrically imposed over the curved inner surface, the flange member having an adapter radius larger than the first radius of the inner surface.

2. The bellmouth adapter of claim 1 wherein means are provided to fix the flange member to the bellmouth.

3. The bellmouth adapter of claim 2 wherein the fixing means further comprises:

one transverse bore in the flange member axially aligned with a corresponding transverse bore in the bellmouth; and a connecting means extending through said aligned transverse bores.

4. The bellmouth adapter of claim 3 wherein the flange member has a second inner curved surface, a tangent line from the second inner curved surface intersecting the axial centerline at a maximum angle from about 60° to about 90°.

5. The bellmouth adapter of claim 4 wherein the tangent line contacts the second inner curved surface adjacent the at least one transverse bore.

6. A bellmouth adapter for attachment to a tubular bellmouth on a vessel for deploying and retrieving a towed body from the vessel, along an axial centerline of the bellmouth and over a first curved inner surface of the bellmouth having a certain first radius, the first curved inner surface having a first tangent line intersecting the centerline of the tubular member to form a first acute angle, the bellmouth adapter comprising a flange member concentrically imposed over the first curved inner surface, the flange member having a second curved inner surface with an adapter radius larger than the first radius, the second curved inner surface having a second tangent line that intersects the centerline of the tubular member to form a second acute angle wherein said second acute angle is larger than said first acute angle.

7. The bellmouth adapter of claim 6 wherein means are provided to fix the flange member to the bellmouth and means are provided to fix the second flange member to the first flange member.

8. The bellmouth adapter of claim 7 wherein the fixing means further comprises:

at least one transverse bore in the flange member axially aligned with a corresponding transverse bore in the bellmouth; and a connecting means extending through said aligned transverse bores in the first flange member and the bellmouth.

9. A method for adapting a bellmouth assembly, the bellmouth assembly comprising a rearwardly extending tubular member having an axial centerline and a distal first flange member extending outwardly from the tubular member, the first flange member having a first curved inner surface, a first line tangent to the first curved inner surface intersecting the centerline of the tubular member to form a first acute angle, wherein said method for adapting said bellmouth comprises the step of concentrically superimposing a second flange member over the first flange member, said second flange member comprising a second curved inner surface having a second tangent line that intersects the centerline of the tubular member to form a second acute angle, wherein said second acute angle is larger than said first acute angle.

10. The method of claim 9 wherein the superimposing step further comprises:

providing at least one transverse bore in the first flange member;

providing corresponding transverse bores axially aligned with said at least one transverse bore; and providing connecting means extending through said aligned bores.

* * * * *